US008517525B2

(12) United States Patent
Chen et al.

(10) Patent No.: US 8,517,525 B2
(45) Date of Patent: Aug. 27, 2013

(54) INK CARTRIDGE FOR INKJET PRINTER

(75) Inventors: Baoquan Chen, Guangdong (CN); Zhizheng Jia, Guangdong (CN)

(73) Assignee: Zhuhai Ninestar Management Co., Ltd., Zhuhai (CN)

( * ) Notice: Subject to any disclaimer, the term of this patent is extended or adjusted under 35 U.S.C. 154(b) by 0 days.

(21) Appl. No.: 13/582,991

(22) PCT Filed: Nov. 22, 2010

(86) PCT No.: PCT/CN2010/078943

§ 371 (c)(1),
(2), (4) Date: Sep. 5, 2012

(87) PCT Pub. No.: WO2011/127734

PCT Pub. Date: Oct. 20, 2011

(65) Prior Publication Data

US 2013/0033552 A1 Feb. 7, 2013

(30) Foreign Application Priority Data

Apr. 16, 2010 (CN) ..... 2010 1 0155221

(51) Int. Cl.
*B41J 2/175* (2006.01)
*B41J 2/14* (2006.01)

(52) U.S. Cl.
USPC ..... 347/86; 347/49

(58) Field of Classification Search
USPC ..... 347/7, 19, 49, 86, 85
See application file for complete search history.

(56) References Cited

U.S. PATENT DOCUMENTS

| | | | | |
|---|---|---|---|---|
| 6,739,689 | B2 * | 5/2004 | Choi | 347/19 |
| 7,562,972 | B2 * | 7/2009 | Hattori et al. | 347/86 |
| 8,167,399 | B2 * | 5/2012 | Nakamura | 347/19 |

* cited by examiner

*Primary Examiner* — Anh T. N. Vo
(74) *Attorney, Agent, or Firm* — Jackson IPG PLLC

(57) ABSTRACT

The invention relates to an ink cartridge for an inkjet printer, which comprises a cartridge body, a detection mechanism and a tension generating component, wherein the cartridge body comprises an ink storage cavity and an ink outlet; the detection mechanism for detecting the ink cartridge and the ink level comprises a first detection component which is matched with a first sensor on the printer, a second detection component which is matched with a second sensor on the printer, and an offsetting component; the second detection component comprises a movable member and a shaft which is arranged inside the cartridge body; the movable member is connected with a rotating shaft of the cartridge body through the shaft; and the tension generating component generates a tensile force to drive the movable member to move towards the direction opposite to the ink cartridge installation direction.

13 Claims, 6 Drawing Sheets

INK CARTRIDGE FOR INKJET PRINTER

FIELD OF THE INVENTION

The invention relates to an ink cartridge for an inkjet printer.

BACKGROUND OF THE INVENTION

An ink cartridge which is engaged with an inkjet printer mainly comprises a storage cavity for storing ink, an ink outlet for supplying ink to a printhead of the printer, and a detection component for detecting the ink cartridge and the ink level. For the sake of guaranteeing the normal operation of the ink cartridge after the ink cartridge is installed into the printer, the ink cartridge must comprise two detection mechanisms. When the ink cartridge is installed into the printer, firstly, one detection mechanism disables light transmitted by a transmitting section of a second sensor on the printer to return to a receiving section of the second sensor; secondly, with the ink cartridge installation, the light transmitted by the transmitting section of the second sensor could return to the receiving section of the second sensor; thirdly, the other detection mechanism disables light transmitted by a transmitting section of a first sensor on the printer to return to a receiving section of the first sensor; and finally, the light transmitted by corresponding transmitting sections of the first sensor and the second sensor cannot return to corresponding receiving sections of the first sensor and the second sensor, and the ink cartridge installation detection is completed herein, then the printer prompts to carry out the next operation. The technical measures for detecting the ink cartridge and the ink level are as follows: the detection mechanisms of the technical proposal mainly realize the detection by blocking light transmitted by sensors, and the operating principle of the detection mechanisms is as follows: when the ink cartridge is installed into the printer, firstly, light transmitted by the second sensor in the printer is blocked by a light-tight second detection component; secondly, the light transmitted by the second sensor is not blocked by the light-tight second detection component while light transmitted by the first sensor is blocked by a first detection component; and finally, the light transmitted by the second sensor is blocked by a light-tight third detection component and the light transmitted by the first sensor is blocked by the first detection component, and herein the printer prompts the existence of the ink cartridge and the admission of the next operation. The third detection component consists of a light-transmitting section and a light-tight movable member; the position of the movable member is varied with the ink level in the ink cartridge; and the ink level in the ink cartridge can be detected by the fact that whether the light transmitted by the second sensor is blocked by the third detection component or not.

As the movable member is arranged inside the ink cavity, the technology can cause ink cartridge installation detection error and ink level detection error due to the fact that the third detection component can be adsorbed due to the surface tension of ink.

In view of the defects of the ink cartridge, the patent CN200910105619.8 discloses another ink cartridge invented, namely an ink cartridge of which a movable member for detection is arranged outside an ink cavity, wherein the movable member can move along with a spring plate and is acted as the second detection component and the third detection component during the ink cartridge installation detection; and the movable member moves when a soft supporting cap is deformed with the varied ink level, and the ink-out detection is completed. A second detection mechanism matched with a second sensor on a printer is matched with the soft supporting cap which is arranged on a cartridge body and communicated with an ink storage cavity, and comprises the movable member, a shaft arranged inside the cartridge body, and the spring plate arranged on the ink cartridge; the movable member is connected with a rotating shaft of the cartridge body through the shaft; and the spring plate can abut against the lower edge of the movable member under the action of the gravity of the movable member. When the ink cartridge is installed, the spring plate does not abut against the movable member again, and the movable member moves around the shaft in virtue of the gravity and abuts against the soft supporting cap when not reaching the upright position, and the ink-out detection is completed. As illustrated in FIG. 1, the traditional ink cartridge 1 for the inkjet printer comprises an ink detection mechanism for detecting the ink level, a detection component 102 matched with a sensor on the printer, and a soft supporting cap 3 arranged on a cartridge body and communicated with an ink storage cavity. On one hand, after ink in the ink storage cavity is out, the soft supporting cap is deformed and light transmitted by the sensor is changed as well. However, as the hardness of the soft supporting cap is difficult to control, the detection error tends to occur in consideration of the gravity of a blocking component. On the other hand, when the soft supporting cap 3 does not support the blocking component, the blocking component moves in virtue of the gravity of the blocking component, When ink or other foreign substance is adhered to the blocking component, the movement deviation of a lever assembly can occur due to the tensile force of the ink or the adsorbability of the foreign substance, and the detection error of the sensor can occur as well. Therefore, the embodiments provided by the invention adopt the elastic force to overcome the process error of the second blocking component and the detection error caused by the foreign substance.

The technical proposal adopted by the above patent has the disadvantage that the process is difficult to realize as the mass of the movable member, the thickness of the soft supporting cap, and the pressure in an ink bag are difficult to control. For example, when the movable member has large mass and the soft supporting cap is relatively thin, maybe there is ink in the ink cartridge, but the soft supporting cap is not thick enough to support the movable member, thus causing the ink cartridge installation detection error of the ink cartridge and simultaneously causing the ink-out detection error.

SUMMARY OF THE INVENTION

The invention provides an ink cartridge for an inkjet printer to solve the technical problem that the ink cartridge installation detection error can be caused by the influence of the gravity of a movable member on the ink cartridge installation detection of the traditional ink cartridge for the inkjet printer.

In order to solve the technical problem, the invention adopts the technical proposal that:

The invention relates to an ink cartridge for an inkjet printer, which comprises a cartridge body and a detection mechanism for detecting the ink cartridge and the ink level, wherein the cartridge body comprises an ink storage cavity for storing ink and an ink outlet for supplying ink to a printhead of the printer; the detection mechanism for detecting the ink cartridge and the ink level comprises a first detection component matched with a first sensor on the printer, a second detection component matched with a second sensor on the printer, and an offsetting component; the second detection component comprises a movable member and a shaft which is arranged on the cartridge body; the movable member is connected with a rotating shaft of the cartridge body through the shaft; the ink cartridge for the inkjet printer also comprises a tension generating component which generates a tensile force to drive the movable member to move towards the direction opposite to the ink cartridge installation direction.

The tension generating component is a tension spring of which one end is connected with the ink cartridge wall and the other end is connected with the movable member.

The tension generating component is a spring of which one end is connected with the offsetting component and the other end is connected with the movable member.

The tension generating component is a group of magnets which attract each other, wherein one magnetic pole is arranged on the ink cartridge wall and the other magnetic pole is arranged on the movable member.

The tension generating component is a group of magnets which repel each other, wherein one magnetic pole is arranged on the offsetting component and the other magnetic pole is arranged on the movable member.

The offsetting component is a spring plate of which one end is fixedly connected with the front wall of the cartridge body and the other end abuts against the wall of a receiving space of the ink cartridge for the printer, wherein a support is arranged on the spring plate; and the movable member is supported by the support on the offsetting component.

The ink cartridge for the inkjet printer also comprises a transmission component for converting the ink level in the ink cartridge into an acting force applied to the movable member.

The transmission component is a lever assembly which comprises a lever; at least one sidewall of the ink storage cavity is a flexible membrane; and one end of the lever is fixedly connected with the flexible membrane while the other end of the lever is an inclined plane and corresponds to an ink level detection position of the movable member.

The support is a supporting slot arranged in the middle of the offsetting component.

The support is a hook arranged in the middle of the offsetting component.

The ink storage cavity also has an elastic component which is arranged at a corresponding position at which the lever is fixedly connected with the flexible membrane.

One end of the lever is fixedly connected with the external surface of the flexible membrane.

One end of the lever is fixedly connected with the internal surface of the flexible membrane; an outlet is reserved at a position at which the lever passes through the ink storage cavity; and a seal ring is arranged between the outlet and the lever.

By adoption of the technical proposal, due to the addition of the tension generating component which generates the tensile force to drive the movable member to move towards the direction opposite to the ink cartridge installation direction the tension generating component generates the tensile force to drive the movable member to move towards the direction opposite to the ink cartridge installation direction during the ink cartridge installation detection, thus the ink cartridge installation detection is carried out without depending on the gravity of the movable member. Therefore, the ink cartridge installation detection is almost not affected by the gravity of the movable member and the technical problem that the ink cartridge installation detection error caused by the influence of the gravity of the movable member on the ink cartridge installation detection of the ink cartridge for the inkjet printer is solved. The ink cartridge for the inkjet printer also comprises the transmission component for converting the ink level in the ink cartridge into the acting force applied to the movable member. As the ink level in the ink cartridge is converted into the acting force applied to the movable member by the transmission component, the movable member is deviated from or at the ink level detection position to detect the ink level, thus the detection precision of the ink level is also improved.

DETAILED DESCRIPTION OF THE PREFERRED EMBODIMENTS

Figure 1:
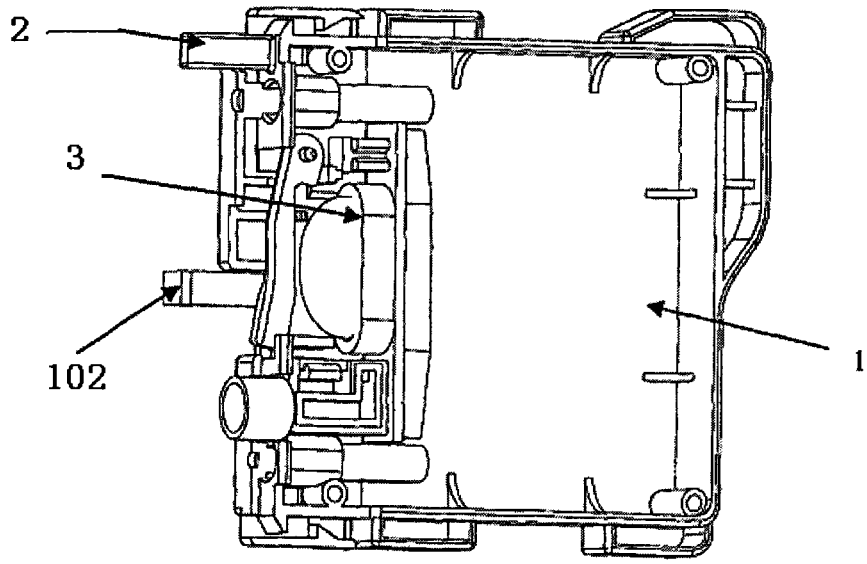
FIG. 1 is a schematic diagram of a detection mechanism of the traditional ink cartridge.
Figure 2:
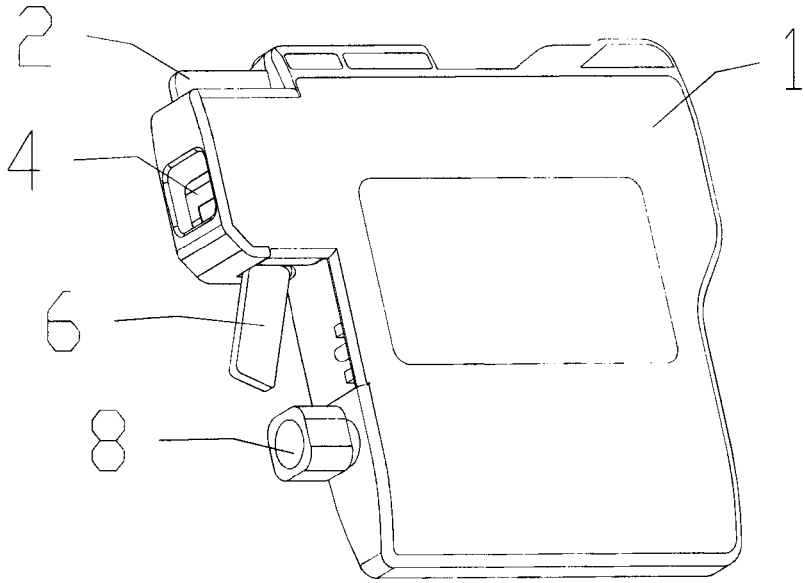
FIG. 2 is a schematic diagram of the ink cartridge provided by the invention.
Figure 7:
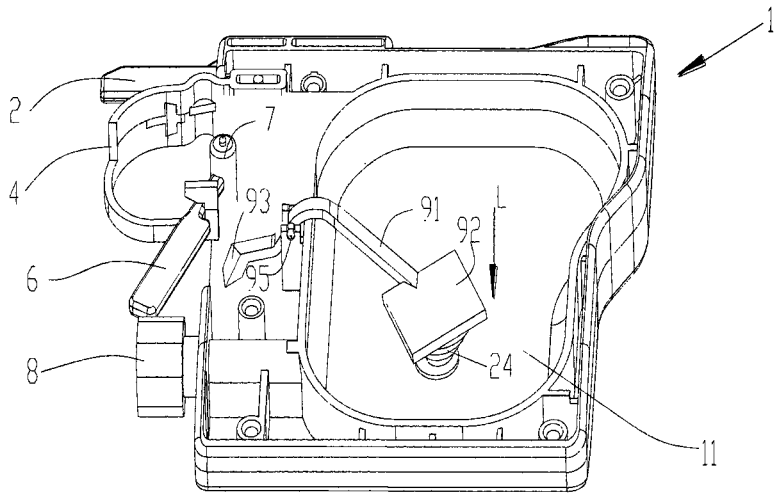
FIG. 7 is a schematic diagram of an ink bag for the ink cartridge.

As illustrated in FIG. 2, the ink cartridge 1 of the embodiments of the invention comprises an ink storage cavity 11 (as illustrated in FIG. 7), an ink cartridge installation detection mechanism (a first detection component 2 and a movable member 6), an ink level detection mechanism (the movable member 6 and a lever assembly 9, as illustrated in FIG. 7), an ink outlet 8 and a spring-actuated mechanism (an offsetting component 4).

Wherein, a fixed quantity of ink is stored into the ink storage cavity 11; at least one outerwall of the ink storage cavity 11 is formed by a deformable membrane; and ink is supplied from the ink storage cavity 11 to a printer through the ink outlet 8.

The ink cartridge installation detection mechanism comprises the first detection component 2 and a second detection component, wherein the second detection component comprises the movable member 6 and a shaft 7.

When the ink cartridge is installed, firstly, a second signal emitted by a second sensor 102 is blocked for the first time by a second signal blocking area 61 of the movable member 6; secondly, a first signal emitted by a first sensor 104 is blocked by the first detection component 2, which is continued in the whole installation process; thirdly, under the action of the offsetting component 4 and a tension generating component 5 together, the movable member 6 rotates around the shaft 7 along the direction opposite to the ink cartridge installation direction, is deviated from the second sensor 102, and does not block the second sensor 102 again; fourthly, when the second blocking component 6, namely the movable member 6, rotates around the shaft 7 to a abutment section 93 at one end of the lever assembly 9, the second blocking component 6 is abutted against by the abutment section 93 and does not move again; and fifthly, the installation process is continued, and the second sensor 102 is blocked by the second signal blocking area 61 of the movable member 6 again, so far the first sensor 104 is blocked by the first detection component 2 while the second sensor 102 is blocked by the movable member 6 and the ink cartridge installation detection is completed. Moreover, the offsetting component 4 is a spring plate of which one end is fixedly connected with the front wall of the cartridge body and the other end abuts against a receiving space of the ink cartridge for the printer; a support is arranged on the spring plate; the movable member is supported by the support on the offsetting component; and the support can be a supporting slot and can also be a hook.

The ink level detection mechanism comprises the second blocking component 6, namely the movable member 6, and the lever assembly 9, wherein the lever assembly 9 comprises a lever 91 and a lever pivot 95; and an abutment section 93 in the shape of an inclined plane is formed at one end of the lever 91, and a flat plate 92 is formed at the other end of the lever 91. Of course, the lever assembly 9 can also be replaced by other transmission components capable of converting the ink level in the ink cartridge into an acting force applied to the movable member, such as a supporting cap which is communicated with the ink storage cavity.

Figure 8:
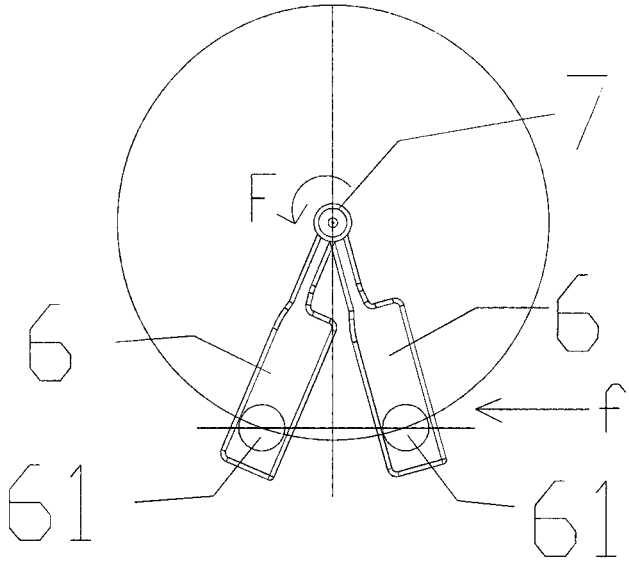
FIG. 8 is a schematic diagram illustrating the detection principle of a second detection mechanism for the ink cartridge.

During the ink level detection, when a fixed quantity of ink (2-3 ml) is consumed, the deformable membrane wall of the ink storage cavity 11 is greatly deformed; the flat plate 92 of the lever 91 is fixedly connected with the membrane and moves along the L direction (as illustrated in FIG. 7); the lever 91 is connected with the abutment section 93 through the lever pivot 95; the abutment section 93 is deviated from a position at which the abutment section 93 abuts against the movable member 6 and does not abut against the movable member 6 again; and under the action of a force F (as illustrated in FIG. 8) of the tension generating component 5, the movable member 6 is deviated from a position at which the movable member 6 blocks the second sensor 102 and does not block the signal of the second sensor again, so far the printer detects the ink-out condition of the ink cartridge 1.

The ink outlet 8 comprises a sealing component which is engaged with an ink supply needle of the printer for sealing to prevent the ink leakage after the installation of the ink cartridge and is self-sealed to prevent the ink leakage in the ink storage cavity 11 when the ink cartridge is not installed into the printer.

The spring-actuated mechanism comprises the offsetting component 4 which can eject out the ink cartridge 1 from an ink cartridge bin 10 when the ink cartridge is not clamped by the fixed clamping rod 105, thus the assembly and disassembly of the ink cartridge is convenient.

When the ink cartridge 1 is detached from the ink cartridge bin 10, the movable member 6 can be reset to an initial ink cartridge installation position by the offsetting component 4.

Figure 3:
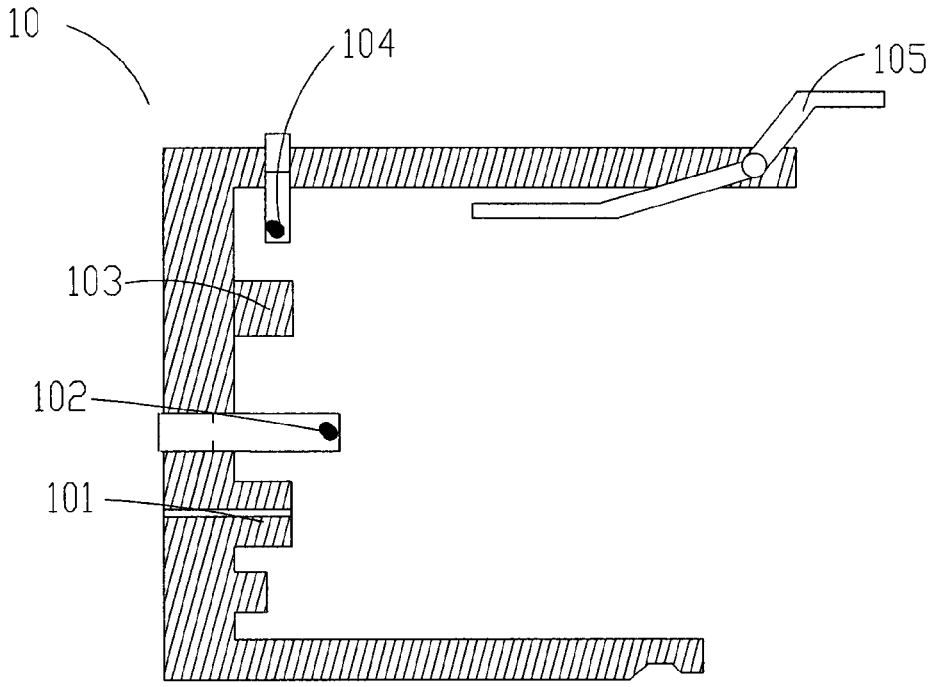
FIG. 3 is a schematic diagram of an ink cartridge bin which is engaged with the ink cartridge.

As illustrated in FIG. 3, the ink cartridge bin 10 of the printer comprises a printer ink supply opening 101, the second sensor 102, a bulge 103, the first sensor 104 and the fixed clamping rod 105, wherein The ink supply opening 101 of the printer can be engaged with the ink outlet 8 of the ink cartridge to convey ink to a printhead after the installation of the ink cartridge 1.

The second sensor 102 can be engaged with the first sensor 104 to complete the ink cartridge installation detection of the ink cartridge 1 and complete the ink level detection in the ink cartridge 1 after the variation of the ink level in the ink cartridge 1.

The bulge 103 can abut against the offsetting component 4 to drive the offsetting component 4 to be in the deformed state.

The first sensor 104 can be engaged with the second sensor 102 to complete the ink cartridge installation detection of the ink cartridge 1.

The fixed clamping rod 105 can be engaged with the bulge on the upper part of the ink cartridge 1 to fix the ink cartridge 1 inside the ink cartridge bin 10.

Figure 4:
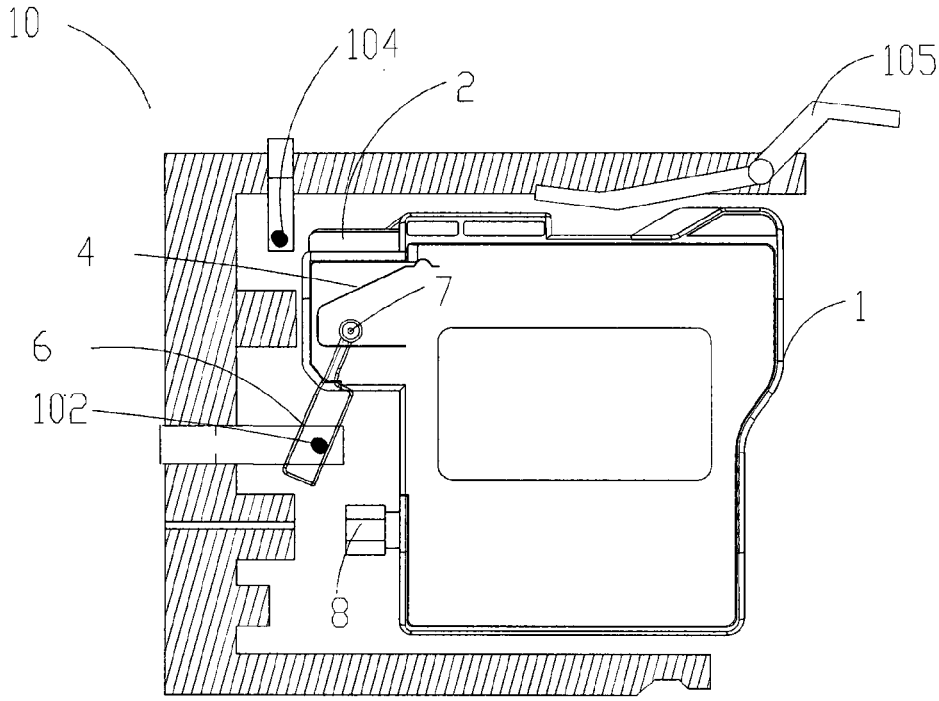
FIG. 4 is a schematic diagram of the ink cartridge during the ink cartridge installation.

As illustrated in FIG. 4, When the ink cartridge is installed, the second signal emitted by the second sensor 102 is blocked for the first time by the second signal blocking area 61 of the movable member 6; the first sensor 104 is not blocked by the first detection component 2; and the fixed clamping rod 105 on the ink cartridge bin 10 is deviated from a fixed position When the ink cartridge is installed 1 and reset to the fixed position after the installation of the ink cartridge 1.

Figure 5:
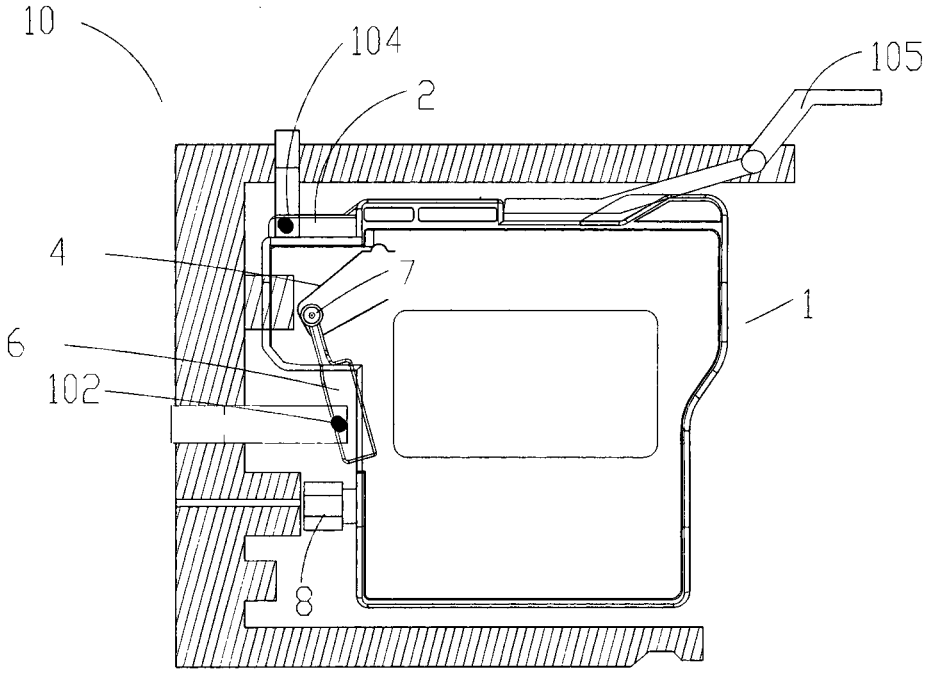
FIG. 5 is a schematic diagram of the ink cartridge after the ink cartridge installation.

As illustrated in FIG. 5, after the installation of the ink cartridge 1, the first sensor 104 is blocked by the first detection component 2 and the second sensor 102 is blocked by the movable member 6; the bulge 103 on the ink cartridge bin 10 of the printer abuts against the offsetting component 4 of the ink cartridge 1, and the offsetting component 4 is in the deformed state; the fixed clamping rod 105 on the ink cartridge bin 10 is at the fixed position after the installation of the ink cartridge 1; and the ink supply opening 101 of the printer is in tight connection with the ink outlet 8 of the ink cartridge 1.

Figure 6:
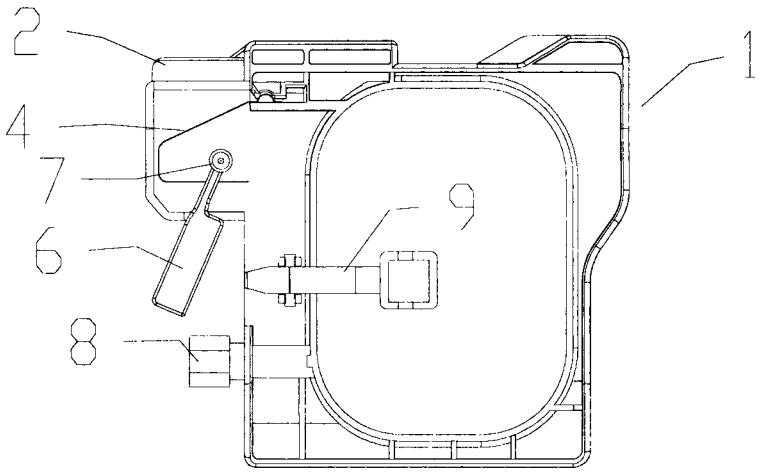
FIG. 6 is a schematic diagram of an internal structure of the ink cartridge provided by the invention.

As illustrated in FIG. 6, a mechanism used together for the ink level detection in the ink cartridge 1 is the lever assembly 9 which can be engaged with the movable member 6 to complete the ink level detection by moving around the shaft with the variation of the membrane wall of the ink storage cavity. As the ink supply opening of the printer has certain suction force, the ink in the ink storage cavity 11 of the ink cartridge 1 can be sucked out. As only the ink outlet 8 of the ink storage cavity 11 is connected with the outside, when the ink level is reduced, the volume of the ink storage cavity 11 is changed and the membrane wall of the ink storage cavity 11 is deformed as well.

As illustrated in FIG. 7, the flat plate 92 at one end of the lever assembly 9 is fixedly connected with the membrane wall of the ink storage cavity 11. The flat plate 92 and the membrane wall can be glued together by double-faced adhesive tape and can also be connected with each other through fixed clamping positions. When the membrane wall is deformed, the flat plate 92 moves along the L direction; the lever 91 is connected with the abutment section 93 through the lever pivot 95; and the abutment section 93 is deviated from the position at which the abutment section 93 abuts against the movable member 6 and does not abut against the movable member 6 again.

The membrane wall of the ink cartridge 1 can be deformed, and the deformed position of the membrane is related to the thickness of the membrane and the pressure born. In order to guarantee that only a connected position of the flat plate 92 and the membrane is deformed when the ink will be out, a spring 24 is arranged at a corresponding position of the flat plate 92 in the ink storage cavity 11 to balance the internal pressure and drive the connected position of the flat plate 92 and the membrane to be deformed finally.

As illustrated in FIG. 8, during the ink cartridge installation detection, the movable member 6 moves around the shaft 7; and in the beginning, the movable member 6 is at a first position and the second signal is blocked by the second signal blocking area 61 of the movable member 6. During the installation, the movable member 6 moves under the action of the force F of the tension generating component 5; when the movable member 6 comes into contact with the abutment section 93 of the lever assembly 9, a abutment force f and the force F are neutralized to drive the movable member 6 to be at a second position which is a blocking position after the installation of the ink cartridge; and when the movable member 6 is at the second position, the second signal is blocked for the second time by the second signal blocking area 61 of the movable member 6, and the ink cartridge installation detection is completed.

Figure 9:
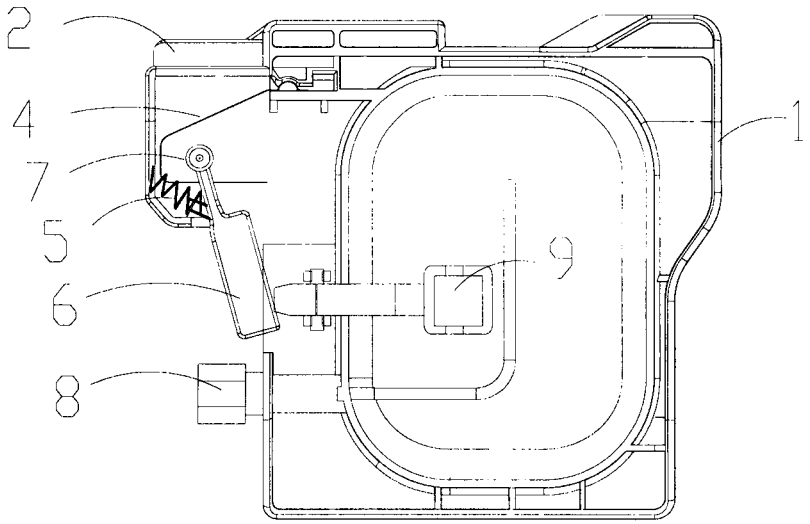
FIG. 9 is a schematic diagram of a tension generating component of a first embodiment of the invention.

As illustrated in FIG. 9, the tension generating component 5 of the ink cartridge in the first embodiment of the invention is a spring of which one end is fixed on the movable member 6 and the other end abuts against the offsetting component. The elastic force applied to the movable member 6 is in the F direction (as illustrated in FIG. 8).

Figure 10:
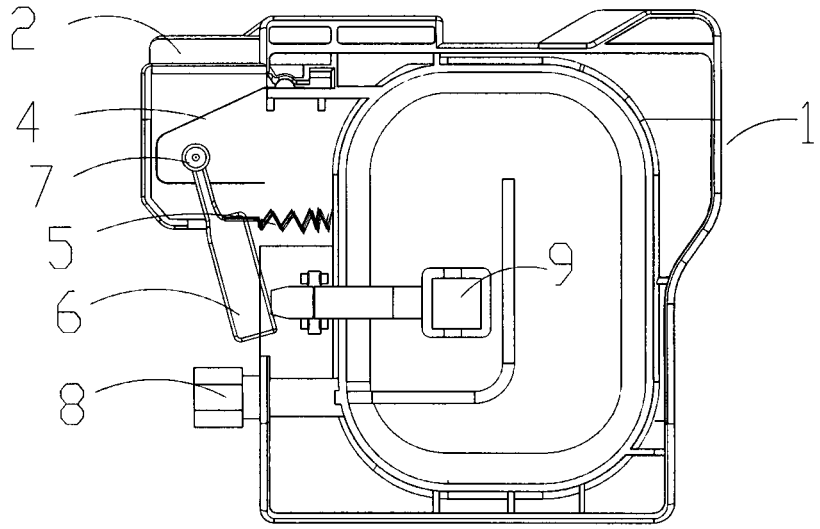
FIG. 10 is a schematic diagram of a tension generating component of a second embodiment of the invention.

As illustrated in FIG. 10, the tension generating component 5 of the ink cartridge in the second embodiment of the invention is a tension spring of which one end is fixed on the movable member 6 and the other end is fixedly connected with the ink cartridge 1. The tensile force applied to the movable member 6 is in the F direction (as illustrated in FIG. 8).

Figure 11:
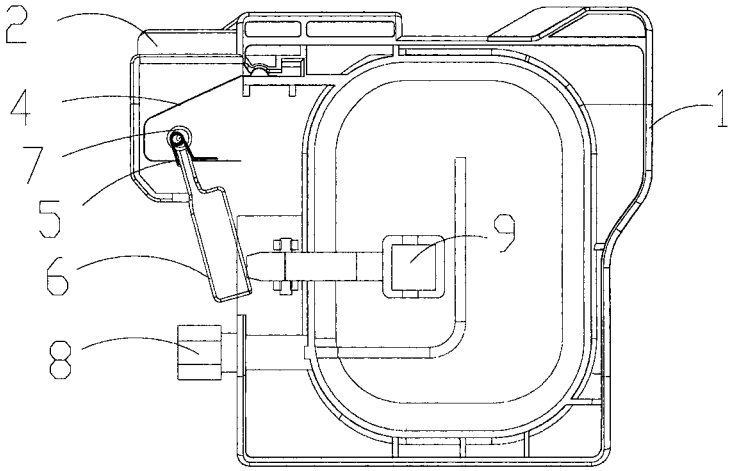
FIG. 11 is a schematic diagram of a tension generating component of a third embodiment of the invention.

As illustrated in FIG. 11, the tension generating component 5 of the ink cartridge in the third embodiment of the invention is a torsion spring of which one end is fixed on the movable member 6 and the other end is fixedly connected with the shaft 7. The torsional force applied to the movable member 6 is in the F direction (as illustrated in FIG. 8).

The tension generating component can be a group of magnets which attract each other, wherein one magnetic pole is arranged on the ink cartridge wall and the other magnetic pole is arranged on the movable member.

The tension generating component can also be a group of magnets which repel each other, wherein one magnetic pole is arranged on the offsetting component and the other magnetic pole is arranged on the movable member.

What is claimed is:

1. An ink cartridge for an inkjet printer, said ink cartridge comprising: a cartridge body and a detection mechanism for detecting said ink cartridge and an ink level, wherein said cartridge body comprises an ink storage cavity for storing ink and an ink outlet for conveying ink to a printhead of said printer;

said detection mechanism for detecting said ink cartridge and the ink level comprises a first detection component matched with a first sensor on said printer, a second detection component matched with a second sensor on said printer, and an offsetting component;

said second detection component comprises a movable member and a shaft arranged inside said cartridge body; said movable member is connected with a rotating shaft of said cartridge body through said shaft; and said ink cartridge for said inkjet printer also comprises a tension generating component generating a tensile force to drive said movable member to move towards the direction opposite to the ink cartridge installation direction.

2. The ink cartridge for an inkjet printer according to claim 1, wherein said tension generating component is a tension spring of which one end is connected with the ink cartridge wall and the other end is connected with said movable member.

3. The ink cartridge for an inkjet printer according to claim 1, wherein said tension generating component is a spring of which one end is connected with said offsetting component and the other end is connected with said movable member.

4. The ink cartridge for an inkjet printer according to claim 1, wherein said tension generating component is a group of magnets which attract each other, wherein one magnetic pole is arranged on the ink cartridge wall and the other magnetic pole is arranged on said movable member.

5. The ink cartridge for an inkjet printer according to claim 1, wherein said tension generating component is a group of magnets which repel each other, wherein one magnetic pole is arranged on said offsetting component and the other magnetic pole is arranged on said movable member.

6. The ink cartridge for an inkjet printer according to claim 1, wherein said offsetting component is a spring plate of which one end is fixedly connected with the front wall of said cartridge body and the other end abuts against the wall of a accommodation space of said ink cartridge for said inkjet printer; a support is arranged on said spring plate; and said movable member is supported by said support on said offsetting component.

7. The ink cartridge for an inkjet printer according to claim 6, wherein said support is a supporting slot arranged in the middle of said offsetting component.

8. The ink cartridge for an inkjet printer according to claim 7, wherein one end of said lever is fixedly connected with the external surface of said flexible membrane.

9. The ink cartridge for an inkjet printer according to claim 7, wherein one end of said lever is fixedly connected with the internal surface of said flexible membrane; an outlet is reserved at a position at which said lever passes through said ink storage cavity; and a seal ring is arranged between said outlet and said lever.

10. The ink cartridge for an inkjet printer according to claim 6, wherein said support is a hook arranged in the middle of said offsetting component.

11. The ink cartridge for an inkjet printer according to claim 1, wherein said ink cartridge for said inkjet printer also comprises a transmission component for converting the ink level in said ink cartridge into an acting force applied to said movable member.

12. The ink cartridge for an inkjet printer according to claim 11, wherein said transmission component is a lever assembly which comprises a lever and a lever pivot; at least one sidewall of said ink storage cavity is a flexible membrane; and one end of said lever is fixedly connected with said flexible membrane while the other end of said lever is an inclined plane and corresponds to an ink level detection position of said movable member.

13. The ink cartridge for an inkjet printer according to claim 12, wherein said ink storage cavity also has an elastic component which is arranged at a corresponding position at which said lever is fixedly connected with said flexible membrane.

* * * * *